US006338614B1

(12) United States Patent
LaRue

(10) Patent No.: US 6,338,614 B1
(45) Date of Patent: Jan. 15, 2002

(54) TURBOCHARGER ANNULAR SEAL GLAND

(75) Inventor: Gerald Duane LaRue, Torrance, CA (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 09/684,451

(22) Filed: Oct. 6, 2000

(51) Int. Cl.[7] ..... F04B 35/00
(52) U.S. Cl. ..... 417/407
(58) Field of Search ..... 417/407, 277

(56) References Cited

U.S. PATENT DOCUMENTS 5,009,519 A * 4/1991 Tatum ..... 384/94
5,076,766 A * 12/1991 Gutknecht ..... 417/407
5,094,587 A * 3/1992 Woollenweber ..... 417/407
5,145,334 A * 9/1992 Gutknecht ..... 417/407
5,823,744 A * 10/1998 Rockwood ..... 416/204 R
5,870,894 A * 4/1999 Woollenweber ..... 417/407
5,890,881 A * 4/1999 Adeff ..... 417/407
5,993,173 A * 11/1999 Koike ..... 417/407
6,032,466 A * 3/2000 Woollenweber et al. ..... 60/607
6,126,414 A * 10/2000 Koike ..... 417/407
6,220,829 B1 * 4/2001 Thompson et al. ..... 417/407

* cited by examiner

*Primary Examiner*—Teresa Walberg
*Assistant Examiner*—Vinod D. Patel
(74) *Attorney, Agent, or Firm*—Felix L. Fischer

(57) ABSTRACT

Lubricating oil leakage in a turbocharger is reduced through the use of a gland seal having multiple channels in the gland face formed by ribs extending radially in a spiral or herringbone pattern for enhanced maximum pumping effect and minimized hoop stress related fatigue failures.

4 Claims, 2 Drawing Sheets

TURBOCHARGER ANNULAR SEAL GLAND

FIELD OF THE INVENTION

This invention relates generally to the field of turbochargers and, more particularly, to a turbocharger annular seal gland seal that is designed having a reduced or eliminated centrifugal stress during use, thereby providing improved turbocharger operating life.

BACKGROUND OF THE INVENTION

Turbochargers for gasoline and diesel internal combustion engines are devices known in the art that are used for pressurizing or boosting the intake air stream, routed to a combustion chamber of the engine, by using the heat and volumetric flow of exhaust gas exiting the engine. Specifically, the exhaust gas exiting the engine is routed into a turbine housing of a turbocharger in a manner that causes an exhaust gas-driven turbine to spin within the housing. The exhaust gas-driven turbine is mounted onto one end of a shaft that is common to a radial air compressor mounted onto an opposite end of the shaft. Thus, rotary action of the turbine also causes the air compressor to spin within a compressor housing of the turbocharger. The spinning action of the air compressor causes intake air to enter the compressor housing and be pressurized or boosted a desired amount before it is mixed with fuel and combusted within the engine combustion chamber.

The common shaft extending between the turbine and compressor is disposed through a turbocharger center housing that includes a bearing assembly for: (1) facilitating shaft rotating action; (2) controlling axially directed shaft thrust effects and radially directed shaft vibrations; (3) providing necessary lubrication to the rotating shaft to minimize friction effects and related wear; and (4) providing a seal between the lubricated assembly and the turbine and compressor housings. The common shaft as used in turbocharger applications is known to have shaft-rotating speeds on the order of 60,000 to 80,000 rpm or higher. Under such operating conditions it is imperative that the bearing assembly provide sufficient lubrication to the shaft to minimize the extreme friction effects that take place at such high rotating speeds, thereby extending shaft service life.

An annular seal gland is installed in the turbocharger center housing and is used to both control axially directed thrust imposed on the shaft from the turbine housing shaft end, i.e., act as a thrust bearing, and to provide a leak-tight seal between the gland and the housing. Because the annular seal gland is interposed between the rotating shaft and static housing surfaces, it is exposed to centrifugal forces that are known to impose a hoop stress onto conventionally designed glands. Such hoop stresses are known to cause the gland to experience fatigue failures. This type of failure adversely impacts the gland's ability: (1) to handle thrust loads; (2) effectively provide friction and heat reducing lubricant to the shaft; and (3) to provide a leak-tight seal between the gland and the housing. An adverse impact on any of these gland performance functions is known to ultimately reduce the service life of the turbocharger.

It is, therefore, desired that a turbocharger annular seal gland be constructed in such a manner as to reduce or eliminate altogether the high centrifugal hoop stresses that can be imposed thereon by placement of the gland between the rotating shaft and static housing. It is also desired that the annular seal gland so constructed be capable of reducing these stresses without adversely impacting the lubricating, thrust load handling, and sealing functions of the gland. It is further desired that the annular seal gland so constructed be capable of retrofit to existing turbocharger devices without extensive redesigning.

SUMMARY OF THE INVENTION

Turbocharger annular seal glands, constructed according to principles of this invention include: (1) a thrust bearing section adjacent a first gland end; (2) a seal groove around an outside gland surface at a gland end opposite the thrust bearing section; and (3) a plurality of open faced lubricant pumping grooves disposed radially along an axial gland surface that mates against an adjacent turbocharger center housing surface. Configured in this manner, annular seal glands of this invention reduce or eliminate the formation of circumferential hoop stresses that can cause fatigue failure and ultimately reduce turbocharger service life.

BRIEF DESCRIPTION OF THE DRAWINGS

The details and features of the present invention will be more clearly understood with respect to the detailed description and the following drawings, wherein.

DETAILED DESCRIPTION OF THE INVENTION

Figure 1:
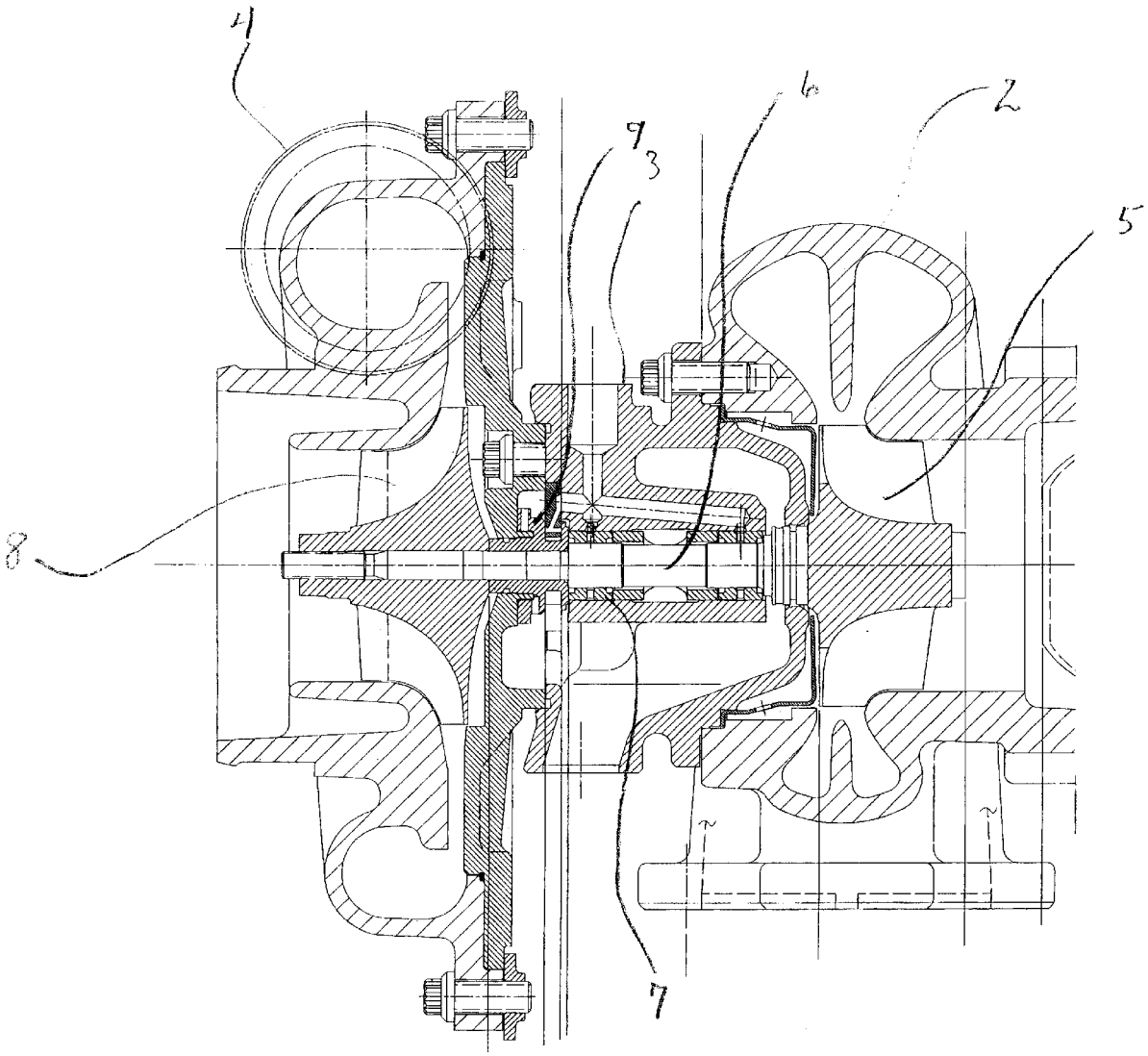
FIG. 1 illustrates a cross-sectional side elevation of a turbocharger showing the arrangement of an annular gland seal.

FIG. 1 shows a turbocharger with a gland seal. The turbocharger incorporates a turbine housing 2, a center housing 3 and a compressor housing 4. A turbine wheel 5 is carried in the turbine housing on a shaft 6 which is supported by bearings 7 in the center housing. A compressor impeller 8 is attached to the shaft opposite the turbine wheel and is carried within the compressor housing. A gland seal 9 is carried on the shaft and engages the center housing back plate.

Figure 2:
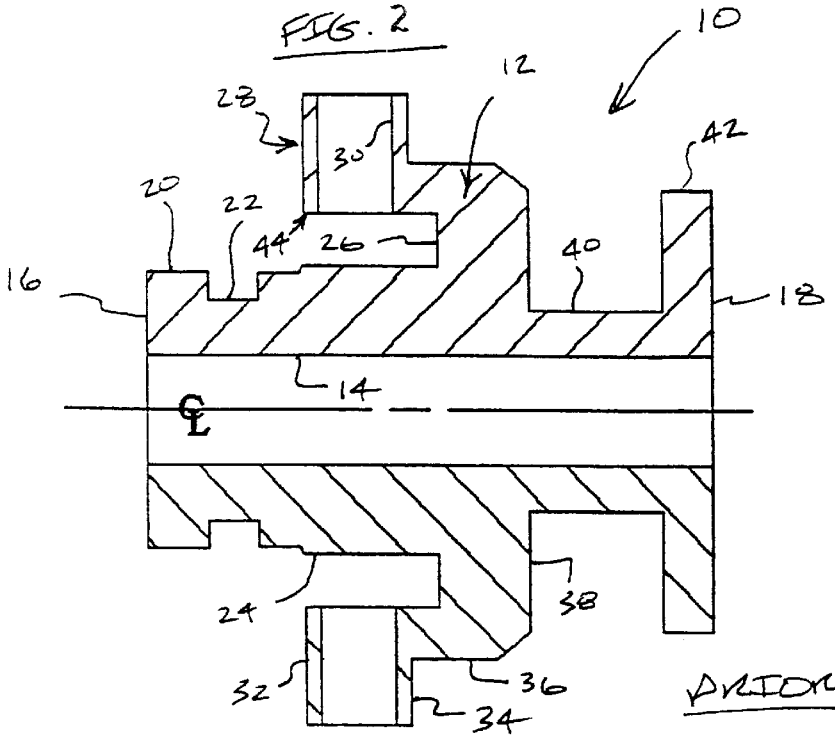
FIG. 2. Is a cross-sectional side elevation of a known turbocharger annular seal gland.

FIG. 2 illustrates a known annular seal gland 10 that is disposed within a turbocharger center housing (not shown) and compressor backplate (not shown). The seal gland comprises a body 12 having a hollow shaft passage 14 extending axially therethrough from a first body end 16 to a second body end 18. The shaft passage is designed to accommodate placement of the rotating turbocharger shaft (not shown) therein. Moving across the gland 10 from left to right across FIG. 1, the gland body 12 is general circular in shape and includes a first diameter section 20 that extends axially a distance away from the first end 16 to a groove 22 that is disposed circumferentially around the body outside surface. The first diameter section 20 is sized to fit within a complementary opening within the compressor backplate. The groove 22 is sized and designed to accommodate placement of an annular sealing ring (not shown) therein that is interposed between the gland body and an adjacent compressor backplate wall surface to provide a leak-tight seal therebetween.

A second diameter section 24 extends axially from the groove 22 to a shoulder 26 that projects radially outwardly away from the second diameter section. The second diameter section 24 has a diameter that is greater than that of the first diameter section 20, and is sized to fit within a complementary wall section of the compressor backplate.

The shoulder 26 is sized and positioned to interact with an axially projecting section of the compressor backplate. The body 12 includes a flange 28 that is directed radially outwardly away from the shoulder 26 and that is configured to facilitate the passage of lubricant, i.e., oil, therethrough. More specifically, the known seal gland flange 28 comprises a plurality of radial oil pumping holes 30 that each pass radially therethrough. the holes 30 are defined axially by a first axial flange surface 32 and an oppositely facing second axial flange surface 34. Each of the axial flange surfaces are continuous and are sized to cooperate with adjacent turbocharger compressor backplate, housing or bearing element surfaces.

A third diameter section 36 extends axially from the flange 28 and has a diameter that is greater than both the first and second diameter sections. The third diameter section 36 is sized to cooperate with a housing member or bearing element within the turbocharger center housing. The third diameter section 26 extends axially to a radially inwardly directed section 38 that is sized to cooperate with a housing member or bearing element within the turbocharger center housing. A fourth diameter section 40 extends axially from the radially inwardly direction section 38 to a radially outwardly flared section 42. The fourth diameter section 40 and radially outwardly flared section 42 are each sized to cooperate with respective housing member or bearing element within the turbocharger center housing.

The gland body flange 28 and/or radially outwardly flared section 40 are designed to control axially-directed thrust loads that are imposed on the gland by the shaft. Additionally, the gland body flange 28 and/or radially outwardly flared section 40 are subjected to radially directed centrifugal loads that are imposed by the rotating shaft. These centrifugal loads are known to impose hoop stresses onto the gland at localized areas; namely, along the point of contact between the inside edge 44 of the first axial flange surface 32 and the adjacent compressor backplate. The known gland described above and illustrated in FIG. 1 is especially susceptible to hoop stress related fatigue failures at this location due to the relatively thin-wall design of the design of the first axial flange surface 32 to provide for the plurality of holes 30. Additionally, the holes 30 are known to be of relatively small diameter that adversely impacts the ability to pumping oil efficiency therethrough.

Figure 3:
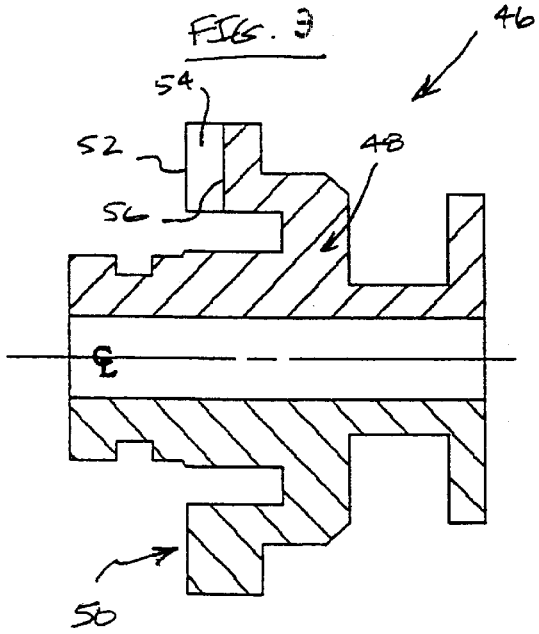
FIG. 3 is a cross-sectional side elevation of a turbocharger annular seal gland constructed according to principles of this invention.

FIG. 3 illustrates an annular seal gland 26 constructed according to principles of this invention. The gland includes a body 48 is configured in the same manner as that described above except for the design of the flange 50. Rather than comprising a plurality of holes that pass radially therethrough between opposed axial surfaces, the flange 50 comprises a first axial flange surface that is defined by a plurality of repeating ribs 52 and slots 54 that are joined together along the flange by a flange base 56.

Figure 4:
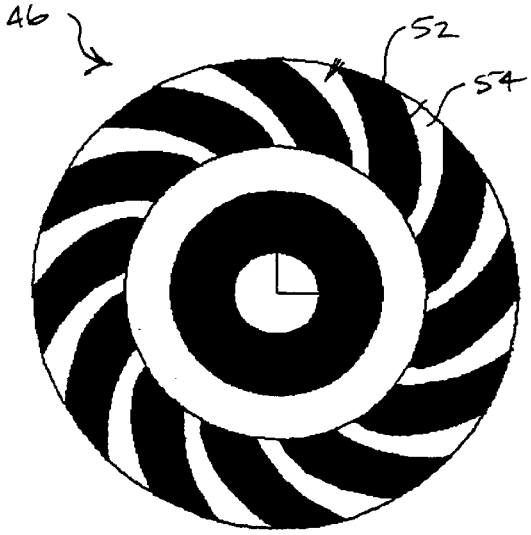
PRIOR ART FIG. 4
FIG. 4 is a front end view of the seal gland in FIG. 2

As illustrated in FIG. 4, the ribs 52 and slots 54 are arranged to extend radially along the flange base. In a preferred embodiment, the flange ribs 52 and slots 54 are arranged radially in a spiral or a herringbone pattern to maximize the pumping action of oil within the slots and through the gland. The slots in the embodiment shown expand from a first width at the inner periphery of flange 50 to a greater second width at the outer periphery of the flange. This scimitar shape further enhances oil flow through the gland. The use of such an open-face slot flange, when compared to the use of the plurality of holes in the known gland, enables the gland designed to customize the geometry of the rib and slot arrangement to achieve a maximum pumping effect. Additionally, the open-face slot flange design minimizes or eliminates altogether the hoop stress related fatigue failures common to the known gland design. Further, the open-face slot flange design enables the seal gland to be produced at near net shape by forging or metal injection molding, thereby improving manufacturing efficiency and costs by avoiding the need to drill the plurality of holes used in the known seal gland design.

Having now described the invention in detail as required by the patent statutes, those skilled in the art will recognize modifications and substitutions to the specific embodiments disclosed herein. Such modifications are within the scope and intent of the present invention.

What is claimed is:

1. An annular seal gland for use within a turbocharger center housing comprising:

a gland body having a hollow shaft passage extending from a first body axial end to an opposite second body axial end;

a flange extending radially outwardly away from the gland body, the flange including an axially-facing surface that comprises a series of repeating ribs extending from a flange case and slots interposed between the ribs, wherein each slot defines a channel extending radially away from the body for the passage of lubricant therethrough.

2. An annular seal gland as defined in claim 1 wherein the ribs extend radially in a spiral pattern.

3. A turbocharger for an internal combustion engine comprising:

a turbine housing;

a compressor housing having a compressor backplate attached thereto;

a shaft housing interposed between the turbine and compressor housing;

a shaft extending through the shaft housing and comprising a turbine at one end extending into the turbine housing, and a compressor at an opposite shaft end extending into the compressor housing;

an annular seal gland disposed within the shaft housing and including a hollow shaft passage extending between axial gland ends, wherein the shaft is disposed within the shaft passage, and wherein the seal gland comprises a flange extending radially outwardly away from the gland body, the flange including an axially-facing surface that comprises a series of repeating ribs extending from a flange case and slots interposed between the ribs, wherein each slot defines a channel extending radially away from the body for the passage of lubricant therethrough, and wherein the ribs are placed into contact against an adjacent portion of the compressor backplate.

4. A turbocharger as defined in claim 3 wherein the ribs of the annular seal gland extend radially in a spiral pattern.

* * * * *